US011742195B2

(12) United States Patent
Lehmann

(10) Patent No.: US 11,742,195 B2
(45) Date of Patent: Aug. 29, 2023

(54) DYNAMIC ION FILTERING FOR REDUCING HIGHLY ABUNDANT IONS

(71) Applicant: Analytik Jena AG, Jena (DE)

(72) Inventor: Roland Lehmann, Jena (DE)

(73) Assignee: Analytik Jena GmbH, Jena (DE)

( * ) Notice: Subject to any disclaimer, the term of this patent is extended or adjusted under 35 U.S.C. 154(b) by 0 days.

(21) Appl. No.: 17/258,068

(22) PCT Filed: Jun. 13, 2019

(86) PCT No.: PCT/EP2019/065429
§ 371 (c)(1),
(2) Date: Jan. 5, 2021

(87) PCT Pub. No.: WO2020/007581
PCT Pub. Date: Jan. 9, 2020

(65) Prior Publication Data

US 2021/0287892 A1 Sep. 16, 2021

(30) Foreign Application Priority Data

Jul. 5, 2018 (DE) ..... 10 2018 116 308.8

(51) Int. Cl.
*H01J 49/06* (2006.01)
*H01J 49/00* (2006.01)

(52) U.S. Cl.
CPC ..... *H01J 49/061* (2013.01); *H01J 49/0031* (2013.01)

(58) Field of Classification Search
CPC .... H01J 49/061; H01J 49/0031; H01J 49/427; H01J 49/428
See application file for complete search history.

(56) References Cited

U.S. PATENT DOCUMENTS 6,534,764 B1 3/2003 Verentchikov et al.
8,637,817 B1 1/2014 Krutchinsky et al.
(Continued)

FOREIGN PATENT DOCUMENTS

WO 2013061097 A2 5/2013
WO 2016170371 A1 10/2016
WO 2016177503 A1 11/2016

OTHER PUBLICATIONS

Meier, Florian, Geyer, Philipp E., Winter, Sebastian Virreira, Cox, Juergen and Mann, Matthias, BoxCar acquisition method enables signle-shot proteomics at a depth of 10,000 proteins in 100 minutes, Nature Methods, Article, https://doi.org/10.1038/s41592-018-0003-5, Nov. 2017, 14 pp.
(Continued)

*Primary Examiner* — David A Vanore
(74) *Attorney, Agent, or Firm* — Christopher R. Powers; Endress+Hauser (USA) Holding, Inc.

(57) ABSTRACT

The present disclosure includes a computer-implemented method for filtering out at least one selected ion from an ion beam by the following steps: determining the selected ion with a selected ion mass, selected charge and/or selected mass to charge ratio; determining at least one predefinable region with predefinable ions, whose ion masses, charges and/or mass to charge ratios are greater than or smaller than the selected ion mass, the selected charge and/or the selected mass to charge ratio of the selected ion; isolating the predefinable region of the ion beam along a trajectory of the ion beam, and detecting the predefinable ions within the predefinable region. In addition, the present disclosure includes to a computer program which is configured to perform a method according to the present disclosure and to a computer program product having the computer program.

16 Claims, 3 Drawing Sheets

(56) References Cited

U.S. PATENT DOCUMENTS

| | | | | |
|---|---|---|---|---|
| 2006/0006326 | A1* | 1/2006 | Belov | H01J 49/0031 250/282 |
| 2011/0204221 | A1 | 8/2011 | Satake et al. | |
| 2012/0168618 | A1 | 7/2012 | Vestal | |
| 2014/0117224 | A1* | 5/2014 | Tate | H01J 49/0031 250/281 |

OTHER PUBLICATIONS

Meier, Florian, Geyer, Philipp E., Winter, Sebastian Virreira, Cox, Juergen and Mann, Matthias, BoxCar acquisition method enables signle-shot proteomics at a depth of 10,000 proteins in 100 minutes, Nature Methods, Supplementary Information, https://doi.org/10.1038/s41592-018-0003-5, 14 pp.

* cited by examiner

DYNAMIC ION FILTERING FOR REDUCING HIGHLY ABUNDANT IONS

CROSS-REFERENCE TO RELATED APPLICATIONS

The present application is related to and claims the priority benefit of German Patent Application No. 10 2018 116 308.8, filed on Jul. 5, 2018, and International Patent Application No. PCT/EP2019/065429, filed on Jun. 13, 2019, the entire contents of which are incorporated herein by reference.

TECHNICAL FIELD

The present disclosure relates to a method for filtering out at least one selected ion from an ion beam, to a computer program which is configured to perform a method according to the present disclosure, and to a computer program product having a computer program according to the present disclosure.

BACKGROUND

The analysis and/or characterization of samples by means of mass spectrometry is nowadays widespread in a wide variety of fields, such as, for example, in chemistry, especially in medical chemistry. Numerous different types of mass spectrometers have become known from the prior art, such as sector-field, quadrupole, or time-of-flight mass spectrometers, or even mass spectrometers with inductively-coupled plasma. The modes of operation of the various mass spectrometers have been described in numerous publications and are therefore not explained in detail here.

In a mass spectrometer, the molecules or atoms to be examined are first converted into the gas phase and ionized. Various methods known per se from the prior art are available for ionization, such as, for example, impact ionization, electron-impact ionization, chemical ionization, photoionization, field ionization, so-called fast atom bombardment, matrix-assisted laser desorption/ionization, or electrospray ionization.

After ionization, the ions pass through an analyzer—also referred to as a mass selector—in which they are separated according to their mass-to-charge ratio m/z. A large number of different variants are also available for the analyzers. The different functional modes are based, for example, on the application of static or dynamic electrical and/or magnetic fields or on the different times of flight of different ions.

The ions separated by means of the analyzer are finally recorded in a detector. In this respect, for example, photomultipliers, secondary electron multipliers, Faraday cups, Daly detectors, microchannel plates, or even channeltrons have become known from the prior art.

Particular requirements for the particular mass spectrometer used arise in the analysis of complex samples, e.g., proteomes of body fluids, for example, serum samples. In terms of the concentration of the ions, such samples have a very wide dynamic range, which is frequently not completely detectable by conventional mass spectrometry. The molecules of interest, e.g., cytokines, chemokines, or tumor markers, are often present in such low concentrations compared to other molecules that they are not detected at all. It is precisely in the case of clinical samples that this can lead to only a fraction of the substances identifiable in more homogeneous cell culture supernatants being detectable. In addition, there may be a poor reproducibility of the respective mass spectrometric analyses, since the re-detection rate of the low-concentration substances is often very low.

It is thus desirable to increase the detection possibilities for low-concentration substances in complex samples.

In this connection, what for example, is known as tandem mass spectrometry has become known in which specific ions are excited in a targeted manner for fragmentation. Examination of the fragmentation patterns enables conclusions to be drawn about the starting products. In this regard, a distinction is drawn between tandem mass spectrometry in space, in which at least two analyzers are coupled in series, and tandem mass spectrometry in time, in which ion traps are used. First, a scan (MS1) is performed over the full mass range. Next, the ions are fragmented in a collision chamber, for example, using a collision gas. With regard to the decomposition products, scans (MS2) are then likewise carried out, but over reduced mass ranges. A scan is understood here to mean the recording of a mass spectrum over a specific mass range.

From the article, "BoxCar acquisition method enables single-shot proteomics at a depth of 10,000 proteins in 100 minutes" by Florida Meier et al., published in Nature Methods (2018) (doi:10.1038/s41592-018-0003-5), a method for the analysis of complex samples with improved sensitivity to low-concentration substances has become known. First, a scan is performed over the full mass range available. Next, the available mass range is divided into several sub-ranges, and the respective ions with masses within the respective sub-range are analyzed successively and separately from each other. In addition, the number of ions to be analyzed can be restricted to within a specific sub-range. Ranges with high intensities in relation to the overall filling can thus be limited. The achievable sensitivity of the mass spectrometer can be increased significantly by the method described, especially with regard to low-concentration ions in complex samples. However, it may be disadvantageous that a compromise must always be found between the duration of a full run and the achievable sensitivity, since the time for a full run increases significantly with the number of sub-ranges. At the same time, the quantity of ions collected from the entire ion beam decreases.

SUMMARY

The aim of the present invention is to further increase the possibilities for detecting low-concentration substances in complex samples.

This aim is achieved by the method, by the computer program and by the computer program product according to the present disclosure.

The method according to the invention is a method, particularly a computer-implemented method, for filtering out at least one selected ion from an ion beam, comprising the following method steps:

- Determining the selected ion with a selected ion mass, selected charge, and/or selected mass-to-charge ratio;
- Determining at least one predefinable region with predefinable ions whose ion masses, charges, and/or mass-to-charge ratios are greater or less than the selected ion mass, the selected charge, and/or the selected mass-to-charge ratio of the selected ion;
- Isolating the predefinable region of the ion beam along a trajectory of the ion beam; and
- Detecting the predefinable ions within the predefinable region.

According to the invention, it is, on the one hand, conceivable to remove from the ion beam individual selected ions with individual selected ion masses, charges, and/or mass-to-charge ratios. However, it is also conceivable to remove from the ion beam ions within selected ranges for the ion masses, charges, and/or mass-to-charge ratios.

The selected ions are, e.g., ions of highly-concentrated substances, e.g., in complex samples, which, however, are not of primary interest for the respective mass analysis.

The at least predefinable region concerns predefinable ions whose ion masses, charges, and/or mass-to-charge ratios differ from the selected ion mass, the selected charge, and/or the selected mass-to-charge ratio of the selected ion. The size of the particular predefinable region is freely selectable and, e.g., application-specific. For example, the predefinable region in question can be determined for only certain sub-ranges of the ion beam or also for all ions in the ion beam whose ion masses, charges, and/or mass-to-charge ratios are not equal to the selected ion mass, the selected charge, and/or the selected mass-to-charge ratio of the selected ion.

Mass spectrometers known from the prior art frequently have only a limited capacity for recording and measuring ions. There is thus a certain saturation of the detector or of any ion trap that may be present. On the other hand, the identification of a specific ion requires a minimum number of these ions in the ion beam. In other words, as a consequence of these two boundary conditions, during analysis by mass spectrometry, many low-concentration substances lie below the detection limit or even the sensitivity limit of the mass spectrometer and thus cannot be identified.

The present invention solves this problem by a targeted and selective removal of certain highly-concentrated substances from the ion beam or by isolating predefinable regions or parts of the ion beam which do not contain these substances. The low-concentration substances will then be present in a larger number within the at least one predefinable region and can be identified by means of, for example, a detector, e.g., a mass spectrometer. The at least one selected ion is, according to the invention, selectively excluded and not detected. It therefore does not impinge on the respective detector—for example, a mass spectrometer. The sensitivity of the mass spectrometer or of the particular detector being used can be significantly increased by the exclusion of the selected ion, and even low-concentration substances can be detected. This represents a major metrological improvement, especially in the field of mass spectrometry, and especially in the fields of analytics and medical diagnostics.

The selected ion can, advantageously, be determined dynamically and at least partially automatically. The systematic exclusion of the selected ion according to the invention brings various advantages over the methods known from the prior art. For example, also detected with increased sensitivity are such predefinable regions with ions whose masses, charges, and/or mass-to-charge ratios lie in the vicinity of the selected mass, the selected charge, and/or the selected mass-to-charge ratio of the selected ion. The sensitivity can also be adjusted in an application-specific manner, e.g., by suitable selection of the at least one predefinable region and/or of the selected ion.

In one embodiment of the method, at least one first and one second predefinable region are determined, wherein the first predefinable region contains predefinable ions whose ion masses, charges, and/or mass-to-charge ratios are greater than the selected ion mass, the selected charge, and/or the selected mass-to-charge ratio of the selected ion, and wherein the second predefinable region contains predefinable ions whose ion masses, charges, and/or mass-to-charge ratios are less than the selected ion mass, the selected charge, and/or the selected mass-to-charge ratio of the selected ion.

In the event that at least two selected ions are being determined, three predefinable regions can, advantageously, be determined, wherein a first predefinable region contains predefinable ions whose ion masses, charges, and/or selected mass-to-charge ratios are less than the first selected ion mass, the first selected charge, and/or the first selected mass-to-charge ratio of the first selected ion. A second predefinable region includes predefinable ions whose ion masses, charges, and/or selected mass-to-charge ratios are greater than the first selected ion mass, the first selected charge, and/or the first selected mass-to-charge ratio of the first selected ion, but less than the second selected ion mass, the second selected charge, and/or the second selected mass-to-charge ratio of the second selected ion. The third predefinable region then contains predefinable ions whose ion masses, charges, and/or selected mass-to-charge ratios are greater than the second selected ion mass, the second selected charge, and/or the second selected mass-to-charge ratio of the second selected ion.

In a further embodiment, the masses, charges, mass-to-charge ratios, and/or intensities of the ions contained in the ion beam or in the predefinable region are determined and/or detected. This can take place by means of, for example, a detector unit of a device designed to carry out the method according to the invention.

In yet another embodiment, at least one mass spectrum of the ion beam and/or of the predefinable region is generated. The mass spectrum can be generated, for example, once in advance or at predefinable time intervals during execution of the method or during filtering. The respective mass spectrum is, e.g., a scan over the entire available mass range or mass-to-charge range or over the predefinable region. The selected ion can thus be determined both on the basis of a full scan or on the basis of a scan of the predefinable region. Different selected ions can also be determined successively, one after the other.

The mass spectrum can also be used to determine, for example, the masses, charges, mass-to-charge ratios, and/or intensities of the ions contained in the ion beam or in the predefinable region. Intensity is a measure of the number of certain ions. In addition to the intensities or instead of the intensities, the number of different ions contained in the ion beam can also be determined.

The selected ion is, e.g., determined on the basis of at least one predefinable criterion. It is advantageous if the selected ion is determined at least on the basis of the mass spectrum and/or on the basis of an ion mass, a charge, a mass-to-charge ratio, and/or an intensity, or when the selected ion is determined on the basis of a list. The list can be, for example, a list (exclusion list) of such ions which are not to be taken into account for the analysis in question. With regard to such a list, it is also conceivable to specify the list once, or to generate it dynamically at predefinable time intervals during the execution of the method.

However, other criteria can also be used to determine the selected ions, e.g., also those relating to the retention time, or those in which the quantities derived from the mentioned quantities are also included.

In a further embodiment, at least one ion whose intensity exceeds a predefinable limit value is selected. In other words, ions upwards of a specific predefinable concentration of the respective substances in the respective sample are selected and deflected. Such a selection of the ion to be filtered out in each case can, advantageously, take place at least partially automatically.

On the basis of the selected ion, a filter pattern can be generated, on the basis of which the predefinable region is isolated.

In a certain embodiment, the predefinable ions are isolated within the predefinable region along the trajectory of the ion beam by, essentially, all ions outside the predefinable region being deflected from the trajectory. In other words, at least the selected ion along the trajectory of the ion beam is deflected from the trajectory.

The deflection can be effected, for example, by means of ion optics, which then serve to prevent ions outside the predefinable region from reaching a detector, or by means of an ion trap, which may be present and arranged in front of the detector, where said ions are collected before detection. For example, deflection of the ions can be effected by, e.g., switchable, electrical, and/or magnetic fields. For this purpose, the ion optics can be designed to be, for example, time-dependently, e.g., dynamically, controllable. For example, they can be quadrupole ion optics.

In another embodiment, the predefinable ions within the predefinable region along the trajectory of the ion beam are isolated by, essentially, all ions outside the predefinable region being stopped along the trajectory. In other words, at least the selected ion is stopped along the trajectory of the ion beam. Accordingly, there is a certain point along the trajectory which the ions outside the predefinable region cannot pass.

This can be achieved, for example, by an ion trap which is arranged along the trajectory of the ion beam. This can be controlled in such a way that the ions outside the predefinable region remain in the ion trap. For this purpose, the ion trap can be designed to be time-dependently, and/or dynamically, controllable.

Another particular embodiment includes enriching or depleting the predefinable ions within the predefinable region. The enriched or depleted ions are then detected afterwards. Here, at least the selected ion is not enriched or depleted.

As a result of the enrichment or depletion, sensitivity with regard to the detectability of low-concentration substances can be increased even further, which can be advantageous, e.g., in the case of particularly low-concentration ions. The enrichment or depletion of the ions may be effected by means of an ion trap, e.g., by means of an Orbitrap or a C-trap.

In this case, it is advantageous if an enrichment factor or depletion factor is determined. In the case of enrichment or depletion in an ion trap, the capacity of the ion trap and the ion input current, for example, are known. If, in addition, the known quantity of applied filtering is determined on the basis of a comparison of recorded mass spectra before and after a filtering has been carried out, the quantity of ions reaching the ion trap can be determined and, accordingly, also specified in advance.

It is thus also advantageous if the predefinable ions within the predefinable region are enriched by a predefinable enrichment factor or depleted by a predefinable depletion factor. By enriching or depleting by a predefinable enrichment factor or depletion factor, it is, advantageously, possible to define, for the predefinable ions of the predefinable region, the proportion by which they are to be enriched or depleted in the ion beam.

It is advantageous if, essentially, only the selected ion is removed from the ion beam. In this way, the entire remaining ion beam can, advantageously, be examined and analyzed with increased sensitivity.

It is also advantageous if at least two different selected ions are determined. In this way, multiple filtering operations can be performed in parallel or sequentially, one after the other. In the case of parallel filtering, the different selected ions can be isolated from the ion beam simultaneously or successively. In the case of several sequential filterings performed consecutively, a component by means of which the selected ion is removed from the ion beam can be adjusted appropriately.

The aim underlying the invention is further achieved by a computer program for filtering out at least one selected ion from an ion beam with computer-readable program code elements which, when executed on a computer, cause the computer to carry out a method according to the invention according to at least one of the described embodiments.

The aim upon which the invention is based is, finally, also achieved by a computer program product with a computer program according to the invention and at least one computer-readable medium on which at least the computer program is at least partially stored.

In summary, the present invention, advantageously, makes it possible to precisely and selectively remove at least one selected ion from an ion beam and thereby, concomitantly, to filter the ion beam. However, it is also possible to select several selected ions or selected ranges of ions, e.g., on the basis of their masses, charges, mass-to-charge ratios, and/or intensities, and to filter them simultaneously or successively.

In this way, sensitivity with regard to the detection of low-dose substances can be significantly increased. In addition to the analysis of complex samples, the present invention can also be used in connection with so-called molecule sorting—for example, in order to filter out certain ions from a mixture. In addition, another possible field of application of the present invention lies in the area of so-called data-independent acquisition (DIA) or also in so-called "all-ion fragmentation." Here, not only can certain ranges be analyzed sequentially, rather, the present invention allows the removal or selection and/or multiplication of molecular patterns and/or molecular classes from the entire range, e.g., by means of specially-adapted filter patterns for filtering the ions in question. For example, a selection can be made with regard to the charge and/or intensity of the ions.

It should be noted that the embodiments described in connection with the method according to the invention can also be applied mutatis mutandis to the computer program according to the invention and to the computer program product according to the invention, and vice versa.

BRIEF DESCRIPTION OF THE DRAWINGS

The present invention will now be explained in greater detail with reference to the following figures. Identical elements in the figures are given the same reference symbols. Shown are.

DETAILED DESCRIPTION

Figure 1:
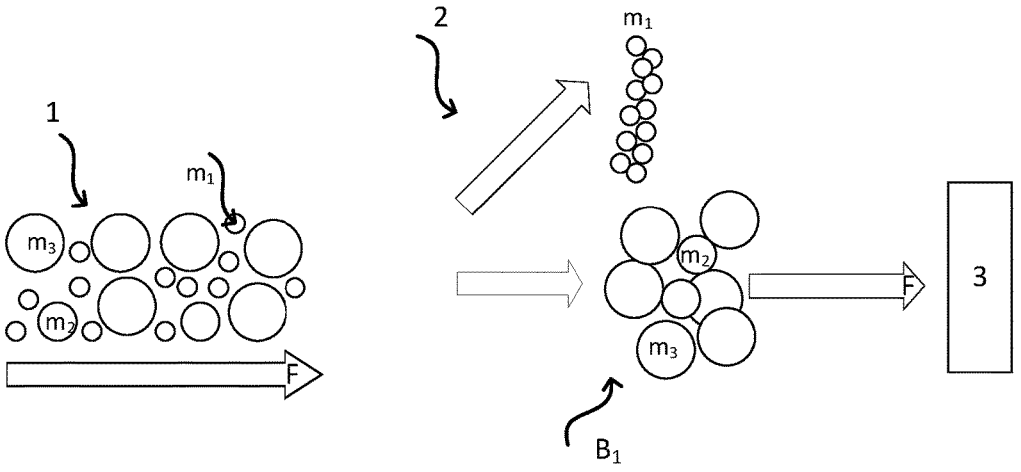
FIG. 1 shows a first, schematically represented, embodiment of a method according to the present disclosure, in which the ions outside the predefinable region are deflected from the trajectory.

FIG. 1 schematically illustrates a first possible embodiment of the method according to the invention. An ion beam 1 contains different ions with different ion masses $m_1$-$m_3$. The ions can also differ in terms of their charges $z_1$-$z_3$ and/or mass-to-charge ratios $m_1/z_1$-$m_3/z_3$. For the sake of simplicity, however, the following description relates only to three different ions contained in the ion beam 1 and having ion masses $m_1$-$m_3$. The considerations can be applied in each case mutatis mutandis with regard to the charges $z_1$-$z_3$ and/or mass-to-charge ratios $m_1/z_1$-$m_3/z_3$.

The ion beam 1 can be generated by any ionization process known from the prior art. In reality, an ion beam 1 contains a plurality of different ions and ion fragments. The three different ions $m_1$, $m_2$, $m_3$ are accordingly to be understood as examples.

According to the invention, at least one ion is selected—here, the ion $m_1$ in the ion beam 1. In addition, at least one predefinable region $B_1$, which does not contain the selected ion $m_1$, is determined. In the present case, the predefinable region $B_1$ contains the ions with the ion masses $m_2$ and $m_3$.

The predefinable region $B_1$ is then isolated along its trajectory F by the selected ion or ions with the ion mass $m_1$ in the ion beam 1 being deflected (2) from the trajectory F. Deflection of the ions can be effected, for example, by means of suitable ion optics.

The selected ions $m_1$ can be determined according to one of the previously described embodiments, e.g., on the basis of their intensity within a mass spectrum of the ion beam 1. The non-deflected ions $m_2$ and $m_3$ within the region $B_1$ can then finally be detected by means of a detector 3. The detector 3 can also be any detector known from the prior art.

In addition to individual selected ions with ion masses $m_1$, it is likewise possible for selected ions within selected ranges for the ion masses, charges, and/or mass-to-charge ratios to be deflected as a whole from the trajectory F.

Figure 2:
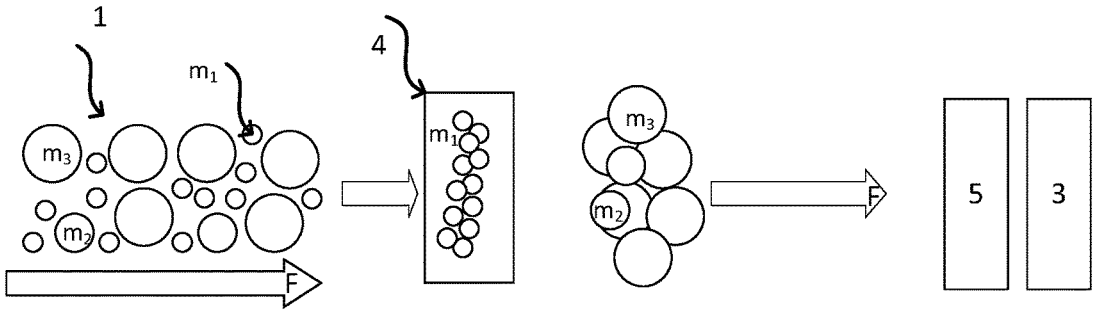
FIG. 2 shows a second, schematically represented, embodiment of a method according to the present disclosure, in which the ions outside the predefinable region are stopped along the trajectory.

FIG. 2 schematically illustrates a further embodiment of the method according to the invention. Also, in the case of FIG. 2, the ion $m_1$ in the ion beam 1 is selected, and the predefinable region $B_1$, which does not contain the selected ion $m_1$, is determined. In the present case, the predefinable region $B_1$ also contains the ions with the ion masses $m_2$ and $m_3$.

In contrast to FIG. 1, according to FIG. 2, in order to isolate the predefinable region $B_1$, the selected ion with ion mass $m_1$ in the ion beam 1 is stopped (4) along the trajectory F. For this purpose, an ion trap can be used, for example, which is designed such that the selected ion with ion mass $m_1$ in the ion beam 1 remains along the trajectory F in the ion trap 4. The non-deflected ions with the ion masses $m_2$ and $m_3$ within the region $B_1$ can then finally be detected by means of the detector 3.

As in the case of FIG. 1, the selected ions with ion masses $m_1$ can be determined according to one of the previously described embodiments—for example, on the basis of their intensity within a mass spectrum of the ion beam 1. In the case of FIG. 2 as well, the detector 3 can be any detector known from the prior art.

In addition to the embodiment in FIG. 1, the device 1 according to FIG. 2 comprises a further ion trap 5, which is arranged in front of the detector 3. The ions with the ion masses $m_2$ and $m_3$ within the predefinable region $B_1$ are enriched or depleted in the ion trap 5 before they impinge on the detector 3.

A schematic illustration of the method according to the invention is the subject matter of FIG. 3. Different mass spectra are there shown over the respective, full available range of the mass-to-charge ratios I(m/z). Furthermore, the ions selected in each case are, for the purposes of FIG. 3, selected on the basis of their mass-to-charge ratios $m_x/z_x$.

Figure 3A:
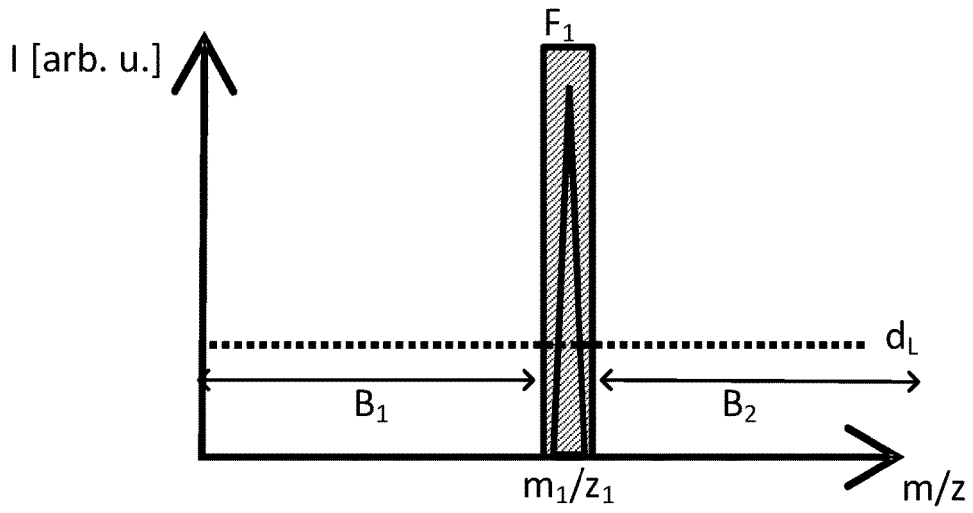
FIGS. 3*a*-3*d* show schematically represented mass spectra (a) before and (b-d) after the filtering out of selected ions from the ion beam in question.

In the mass spectrum shown in FIG. 3*a*, ions with the mass-to-charge ratio $m_1/z_1$ can be identified. In other words, for ions with the mass-to-charge ratio $m_1/z_1$, the mass spectrum has an intensity I above the sensitivity limit $d_L$ of the mass spectrometer with which the mass spectrum was created. Ions with other mass-to-charge ratios $m_x/z_x$ are not identifiable due to their low concentrations within the ion beam 1.

To carry out the method according to the invention, the ions with the mass-to-charge ratio $m_1/z_1$ are selected and filtered out or removed from the ion beam 1. For this purpose, a filter window $F_1$, containing the mass-to-charge ratio $m_1/z_1$, or a selected range containing the mass-to-charge ratio $m_1/z_1$ can, for example, be determined that contains selected ions. However, it is also possible to select only ions with a mass-to-charge ratio $m_1/z_1$.

Next, a first predefinable region $B_1$ is determined that contains ions with mass-to-charge ratios $m_x/z_x$ which are smaller than the mass-to-charge ratio $m_1/z_1$. In the present case, the first predefinable region $B_1$ comprises all ions with mass-to-charge ratios $m_x/z_x<m_1/z_1$. However, this is not absolutely necessary. The first predefinable region $B_1$ can also be a portion of the ions with mass-to-charge ratios $m_x/z_x<m_1/z_1$. According to FIG. 3*a*, a second predefinable region $B_2$ is also determined, which contains ions with mass-to-charge ratios $m_y/z_y$, where $m_1/z_1<m_y/z_y$.

In other embodiments, only a single predefinable region $B_1$ can also be determined. Likewise, more than two predefinable regions $B_1$ and $B_2$ can also be determined. All of these cases are also covered by the present invention. Each predefinable region $B_x$ contains predefinable ions with at least one predefinable mass-to-charge ratio $m_x/z_x$. However, it should be noted that the respective selected ions and predefinable regions can also be determined in other ways—for example, on the basis of ion masses, charges, and/or intensities.

In the case of FIG. 3, the first and second regions $B_1$ and $B_2$ of the ion beam 1 are isolated from the remaining parts of the ion beam 1 for the purpose of filtering. This can be done, for example, using one of the embodiments shown in FIG. 1 or 2. The filter pattern used in FIG. 3*a* here comprises the filter window $F_1$.

Figure 3B:
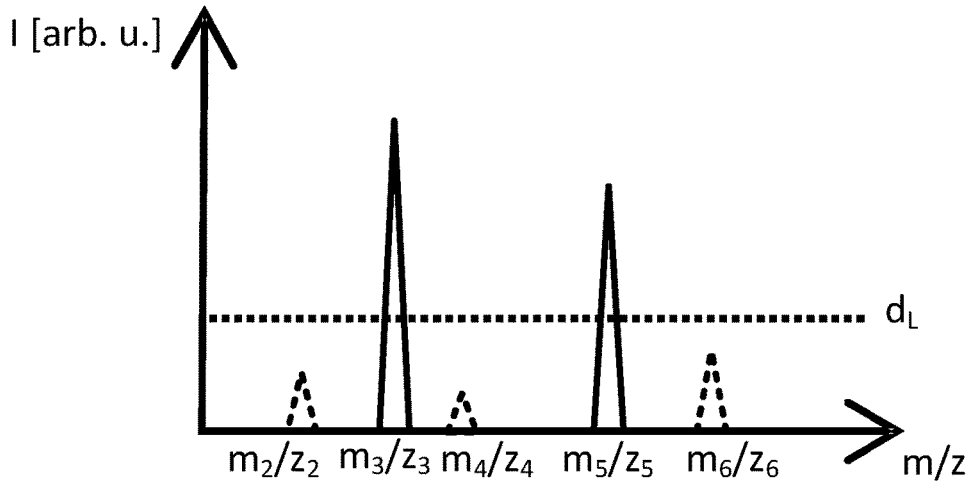

The result of the filtering is shown in FIG. 3*b*. By the removal of the selected ions having a mass-to-charge ratio $m_1/z_1$, the sensitivity limit $d_L$ has been significantly reduced, so that, now, even the ions with the mass-to-charge ratios of $m_3/z_3$ and $m_5/z_5$ are detectable due to the downward shift in the dynamic sensitivity range $d_L$. However, the intensities of the ions with mass-to-charge ratios $m_2/z_2$, $m_4/z_4$, and $m_6/z_6$—shown as dashed lines—still lie below the sensitivity limit $d_L$.

In order to be able to detect these ions as well, additional or further filtering must be carried out. For example, several selected ions can be removed from the ion beam 1 in a filtering process. Alternatively, multiple filtering operations may be performed sequentially with respect to different selected ions. This is also the case in FIGS. 3*c* and 3*d*.

Figure 3C:
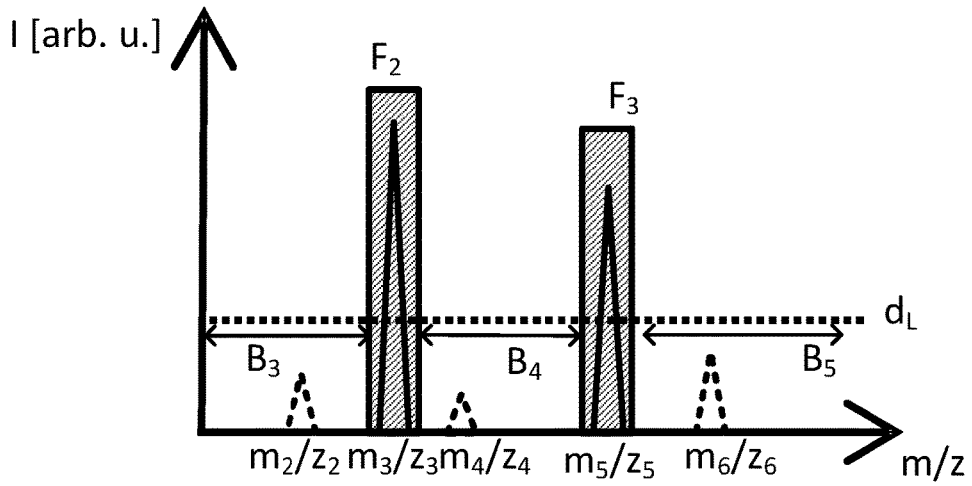

In order to be able to detect even less concentrated substances, such as the ions with the mass-to-charge ratios $m_2/z_2$, $m_4/z_4$, or $m_6/z_6$, according to FIG. 3*c*, ions with the mass-to-charge ratios $m_3/z_3$ and $m_5/z_5$ are selected, and three further predefinable regions $B_3$-$B_5$ determined. Furthermore, the filter windows $F_2$ and $F_3$ can be determined on the basis of the selected ions. The third predefinable region $B_3$ includes, in the example shown, ions with mass-to-charge ratios to which $m_x/z_x<m_3/z_3$ applies. The fourth predefinable region $B_4$ contains ions with mass-to-charge ratios to which $m_3/z_3<m_x/z_x<m_5/z_5$ applies, and the fifth predefinable region $B_5$ contains ions with mass-to-charge ratios to which $m_x/z_x>m_5/z_5$ applies.

Figure 3D:
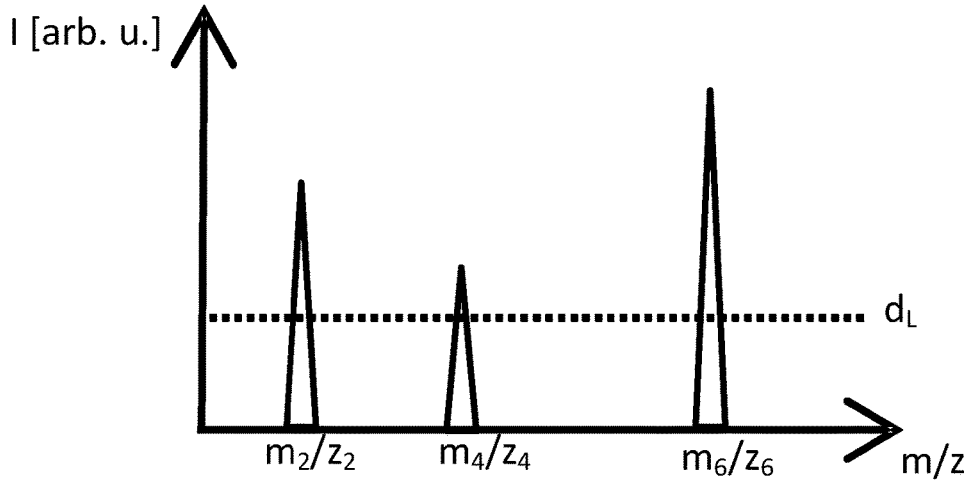

After the isolation of the predefinable regions $B_3$-$B_5$, the ions with the mass-to-charge ratios of $m_2/z_2$, $m_4/z_4$, or $m_6/z_6$ are also clearly detectable, as illustrated in FIG. 3*d*.

It should be noted that, for the isolation and detection of the predefinable regions $B_1$-$B_5$, in the case of more than one predefinable region, a wide variety of possibilities are conceivable and fall under the present invention. The predefinable regions $B_1$-$B_5$ can, for example, be isolated and detected successively or simultaneously. The individual regions can also be isolated one after the other and collected, but then detected together.

Depending upon the application, using the method according to the invention, suitable filter patterns can be conceived which filter out selected ions with a mass-to-charge ratio $m_x/z_x$ or ions of selected ranges for selected mass-to-charge ratios $m_x/z_x$-$m_y/z_y$, or which remove the corresponding ions from the ion beam 1.

The invention claimed is:

1. A computer-implemented method for increasing a sensitivity of a mass spectrometer, the method comprising:

selecting an ion from an ion beam, the selected ion having a selected ion mass, selected charge, and/or selected mass-to-charge ratio for which an intensity in a mass spectrum exceeds a limit value;

filtering the selected ion from the ion beam, the filtering comprising:

defining a portion of the ion beam comprising other ions whose ion masses, charges and/or mass-to-charge ratios are greater or less than the selected ion mass, the selected charge and/or the selected mass-to-charge ratio of the selected ion, respectively;

isolating the other ions of the defined portion of the ion beam along a trajectory of the ion beam, wherein the selected ion is stopped along the trajectory using a first ion trap; and enriching or depleting the other ions using a second ion trap; and detecting the other ions within the defined portion of the ion beam using a detector of the mass spectrometer.

2. The method of claim 1, wherein:

the defined portion includes a first portion and a second portion;

the first portion includes other ions whose ion masses, charges and/or mass-to-charge ratios are greater than the selected ion mass, the selected charge and/or the selected mass-to-charge ratio of the selected ion, respectively; and the second portion includes other ions whose ion masses, charges and/or mass-to-charge ratios are less than the at least one selected ion mass, the selected charge and/or the selected mass-to-charge ratio of the selected ion, respectively.

3. The method of claim 1, wherein the masses, charges, mass-to-charge ratios and/or intensities of ions of the ion beam are determined, or wherein the masses, charges, mass-to-charge ratios and/or intensities of the other ions comprising the defined portion are determined.

4. The method of claim 1, wherein at least one mass spectrum of the ion beam and/or of the defined portion is generated.

5. The method of claim 4, wherein the selected ion is selected at least based on the at least one mass spectrum and/or on an ion mass, a charge, a mass-to-charge ratio and/or an intensity, or wherein the selected ion is selected based on a list.

6. The method of claim 1, wherein substantially all ions outside the defined portion are deflected from the trajectory.

7. The method of claim 1, wherein substantially all ions outside the defined portion are stopped along the trajectory.

8. The method of claim 1, wherein an enrichment factor or depletion factor is determined.

9. The method of claim 1, wherein the other ions of the defined portion are enriched or depleted with a predefinable enrichment factor or with a predefinable depletion factor.

10. The method of claim 1, wherein, substantially, only the selected ion with the selected ion mass, charge, and/or mass-to-charge ratio is removed from the ion beam.

11. The method of claim 1, wherein the selected ion includes at least two different selected ions, each having a selected ion mass, charge, and/or mass-to-charge ratio, and wherein the at least two different selected ions are determined.

12. A non-transitory computer-readable medium for increasing a sensitivity of a mass spectrometer, comprising instructions thereon, that when executed by a computer, cause the computer to perform the method according to claim 1.

13. The method of claim 1, wherein, substantially, only the selected ion with the selected ion mass, charge, and/or mass-to-charge ratio is deflected from the ion beam.

14. A method for increasing a sensitivity of a mass spectrometer, the method comprising:

selecting an ion from an ion beam, the selected ion having a selected ion mass, selected charge, and/or selected mass-to-charge ratio for which an intensity in a mass spectrum exceeds a limit value;

filtering the selected ion from the ion beam, the filtering comprising:

defining a portion of the ion beam comprising other ions whose ion masses, charges and/or mass-to-charge ratios are greater or less than the selected ion mass, the selected charge and/or the selected mass-to-charge ratio of the selected ion;

isolating the other ions of the defined portion of the ion beam along a trajectory of the ion beam, wherein the selected ion is removed from the defined portion of the ion beam using ion optics, or wherein the selected ion is stopped along the trajectory using a first ion trap; and enriching or depleting the other ions using a second ion trap; and detecting the other ions within the defined portion of the ion beam using a detector of the mass spectrometer, wherein:

the defined portion includes a first portion and a second portion;

the first portion includes other ions whose ion masses, charges and/or mass-to-charge ratios are greater than the selected ion mass, the selected charge and/or the selected mass-to-charge ratio of the selected ion, respectively; and the second portion includes other ions whose ion masses, charges and/or mass-to-charge ratios are less than the at least one selected ion mass, the selected charge and/or the selected mass-to-charge ratio of the selected ion, respectively.

15. The method according to claim 14, wherein the first portion and second portion are isolated and detected successively.

16. The method according to claim 14, wherein the first portion and second portion are isolated one after the other, collected in the second ion trap, and subsequently detected together.

* * * * *